United States Patent [19]

Narozny

[11] 4,371,225

[45] Feb. 1, 1983

[54] ELECTRICAL CONNECTOR FOR TERMINATING FLAT MULTICONDUCTOR CABLE

[75] Inventor: Ronald S. Narozny, Panorama City, Calif.

[73] Assignee: Thomas & Betts Corporation, Raritan, N.J.

[21] Appl. No.: 174,234

[22] Filed: Jul. 31, 1980

[51] Int. Cl.[3] ..... H01R 4/24

[52] U.S. Cl. ..... 339/97 C

[58] Field of Search ..... 339/97 R, 97 C, 97 P, 339/98, 99 R; 174/84 C

[56] References Cited

U.S. PATENT DOCUMENTS 3,964,815 6/1976 McDonough ..... 339/97 C 4,082,402 4/1978 Kinkaid et al. ..... 339/97 C

FOREIGN PATENT DOCUMENTS 932419 8/1973 Canada ..... 339/97 C

*Primary Examiner*—John McQuade

*Attorney, Agent, or Firm*—Robert M. Rodrick; Salvatore J. Abbruzzese; Jesse Woldman

[57] ABSTRACT

A connector for terminating flat cable has insulation piercing teeth adapted, by disposition on different longitudinal side margins of a web, to provide strain relief for a cable along a plurality of separate longitudinal axes.

12 Claims, 6 Drawing Figures

ELECTRICAL CONNECTOR FOR TERMINATING FLAT MULTICONDUCTOR CABLE

FIELD OF THE INVENTION

This invention relates generally to electrical connections for flat multiconductor cable and pertains more particularly to connectors of type having insulation-piercing capability for making connection with cable conductors and also providing terminals extending outwardly of the cable for providing contact with accessory circuitry.

BACKGROUND OF THE INVENTION

Known connectors having the above-noted capabilities of insulation-piercing and terminal defining are typically comprised of a conductive member having a flat web portion with sharpened teeth extending upwardly of opposed side margins of the web portion, the web portion having a flat elongate extent distal from the teeth and providing a terminal or contact in the form of a lug or socket. In one known connector type, seen in U.S. Pat. Nos. 3,395,381, 3,696,322 and 4,012,101, the transverse extent of the web portion, i.e., the spacing between opposed teeth, is selected to be of extent greater than the width of the individual flat conductor to which connection is to be made. In assembling the connector and conductor, all teeth approach the cable in registry with the cable electrical insulation and pass through the insulation without interference with the conductor. At this juncture, the teeth are deformed downwardly through the insulative casing interiorly of side margins of the conductor and into insulation-displacing or -piercing electrical contact with the conductor. In another known connector type, the spacing between opposed teeth is less than the width of the flat conductor, as in U.S. Pat. No. 4,082,402. As the teeth engage the multiconductor cable, they pass through the cable insulation and into interfering relation with the underside of the conductor, deforming the conductor and electrically engaging side margins as the connector passes fully through the cable. The teeth are then directed downwardly onto the cable insulation, displacing the same and electrically engaging and piercing through the conductor.

In these known connectors, the insulation piercing teeth on each marginal side of the web portion of the connector are in longitudinal alignment and function identically in their passage through the electrical cable. In the first-mentioned instance, teeth pass through insulation only prior to being bent back upon the cable and in the second-noted instance, all teeth interfere with the conductor in passing through the cable prior to being bent back thereupon. To the extent that these prior connectors provide both electrical connection and afford strain relief to the multiconductor cable, both these performance characteristics are dependent upon and derived from side margin teeth of such common longitudinal dispositions.

SUMMARY OF THE INVENTION

It is an object of the present invention to provide improved connectors for terminating flat multiconductor cable.

A more particular object of the invention is to provide connectors of this type wherein cable strain relief may be provided both through teeth making electrical interconnection and by structure independent of the electrical connection teeth.

In the attainment of the foregoing and other objects, the invention provides a flat multiconductor cable terminating connector comprised of an elongate electrically conductive member having an end portion defining a contact or terminal, a longitudinally successive portion of web configuration and having first transversely opposed teeth adapted for cable conductor piercing and a further longitudinally successive portion having side margins transversely outward of the insulation-piercing tooth portion and supporting additional tooth means adapted to pierce electrical insulation only or cable conductors at locations transversely outward of piercing locations of the first teeth. The terminal or contact portion of the connector may be in any one of several configurations, e.g., lug, socket, etc.

The foregoing and other objects and features of the invention will be understood in further detail from the following detailed description of preferred embodiments thereof and from the drawings wherein like reference numerals identify like parts throughout.

DESCRIPTION OF PREFERRED EMBODIMENTS

Figure 1:
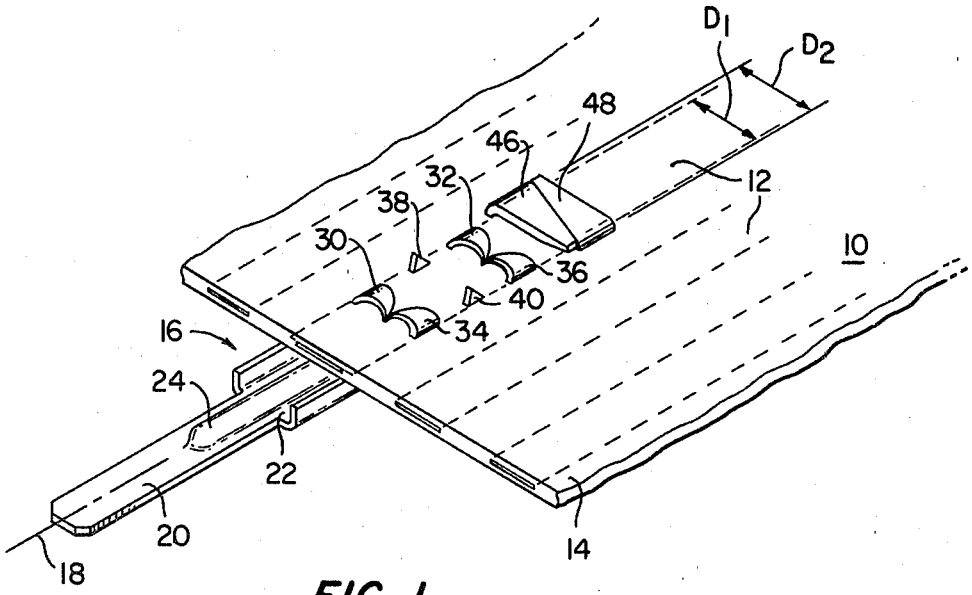
FIG. 1 is a perspective showing of a connector in accordance with the invention assembled with a flat multiconductor cable.
Figure 2:
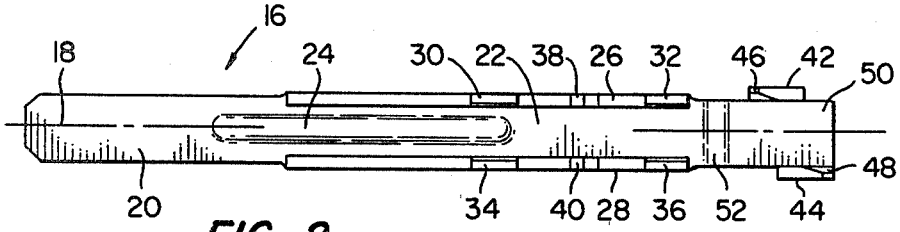
FIG. 2 is a plan view of the FIG. 1 connector prior to the assembly thereof with the FIG. 1 cable.
Figure 3:
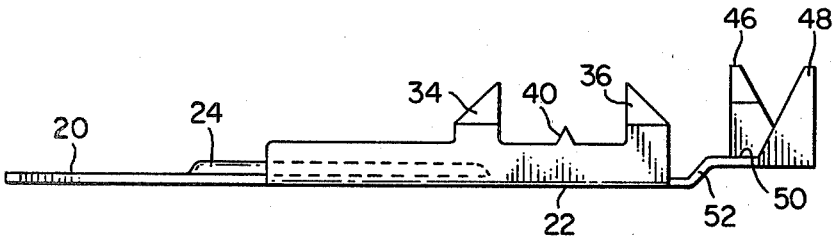
FIG. 3 is a front elevation of the FIG. 2 connector.
Figure 4:
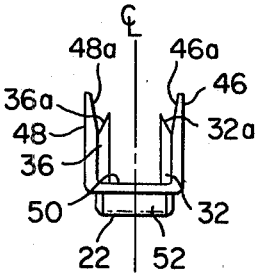
FIG. 4 is a side elevation of the FIG. 3 connector.

Referring to FIGS. 1–3, flat cable 10 includes a plurality of rectangular cross-section elongate conductors 12 within electrically insulative casing 14. In FIG. 1, connectors 16 are shown assembled with flat cable 10 at an end margin thereof. Connectors 16 are elongate along longitudinal axis 18 and comprise a terminal or contact portion 20, in the form of a lug in FIGS. 1–3. Portion 20 is formed as an extension of web portion 22 of an integral electrically conductive member, a strengthening rib 24 preferably extending longitudinally from the web portion onto the terminal portion. Web portion 22 includes side margins 26 and 28, from which extend respectively first and second pairs of sharpened teeth. Thus, longitudinally spaced teeth 30 and 32, comprising one pair, extend generally orthogonal to the web portion coincident with side margin 26. Teeth 34 and 36, longitudinally spaced in respective lateral opposition to teeth 30 and 32, comprise the second teeth pair and extend generally orthogonal to web portion 22, coincident side margin 28. Notch teeth 38 and 40 may be disposed longitudinally between the teeth of each pair. As indicated in FIG. 4 particularly, tooth 36 includes a chamfered or tapered surface **36*a* at its end distal from web portion 22 and tapering outwardly to side margin 28. Tooth 34 is of identical configuration to tooth 36. FIG. 4 also indicates the configuration of opposed tooth 32 as having a chamfered surface 32*a* at its end distal from web portion 22 and tapering also outwardly to side margin 26**.

Side margins 42 and 44 of the integral conductive member constituting the connector of FIGS. 1–3 are situated laterally opposite one another, each laterally outwardly of corresponding side margins 26 and 28. A pair of teeth 46 and 48 extend generally orthogonal to end section 50 of web 22, section 50 being a plane parallel to the plane of web portion 22 and joined thereto by inclined web section 52. FIG. 4 indicates teeth 46 and 48 to include chamfered surfaces 46*a* and 48*a* at ends thereof distal from web section 50. These chamfered surfaces both taper laterally inwardly of side margins 42 and 44.

In a preferred practice, the respective lateral spacings between tooth pairs 30,32 and 34,36 are selected to be of measure $D_1$ (FIG. 1), i.e., a distance not greater than the width of conductors 12 of flat cable 10. By this preselection, teeth 30–36 and notch teeth 38 and 40 may be placed in common registry with a conductor 12 of flat cable 10. Upon forcing of the cable onto connector 16 by suitable tooling, all such teeth pierce the underside of cable insulation 14, penetrate and pass through conductor 12 and pierce and pass through insulation 14 above the conductor. The upper portions of the teeth may now be rolled or otherwise deformed downwardly upon cable 10, as indicated in FIG. 1.

The lateral spacing between teeth 46 and 48 is selected to be of measure $D_2$ (FIG. 1), i.e., a distance sufficiently in excess of the width of conductors 12 to insure that side margins 42 and 44 and the totality of teeth 46 and 48 are disposed outwardly of conductor 12 when teeth 30–36 are disposed, as above discussed, in confronting relation to conductor 12. Upon forcing of the cable onto connector 16, teeth 46 and 48 pierce insulative casing 14 only and do not confront conductor 12. Upon seating of web section 50 against the undersurface of cable 10, teeth 46 and 48 extend fully above cable 10 and are forced downwardly thereon, to reach the configuration shown in FIG. 1. Teeth 46 and 48 may be conveniently shaped in triangular fashion, such that they interleave with one another to provide a continuous rectangular surface atop cable 10 upon crimping thereon.

As noted above, the chamfered surfaces of teeth 30–36 in a direction outwardly of center line CL (FIG. 4), thereby providing the sharpened tips of the teeth interiorly of the margins of conductor 12. Conversely, the chamfered surfaces of teeth 46 and 48 extend inwardly toward connector center line CL, thus providing that the sharpened tips of teeth 46 and 48 pierce insulation of flat cable 10 substantially outwardly of conductors 12. The effect of the chamfered surfaces of teeth 30–36 is to direct the sharpened portions thereof inwardly toward center line CL, assuring communication of teeth 30–36 with conductor 12. Conversely, the chamfered surfaces of teeth 46 and 48 serve to assure that the sharpened tips of these teeth will remain in piercing relationship only to the cable insulation 14.

Figure 5:
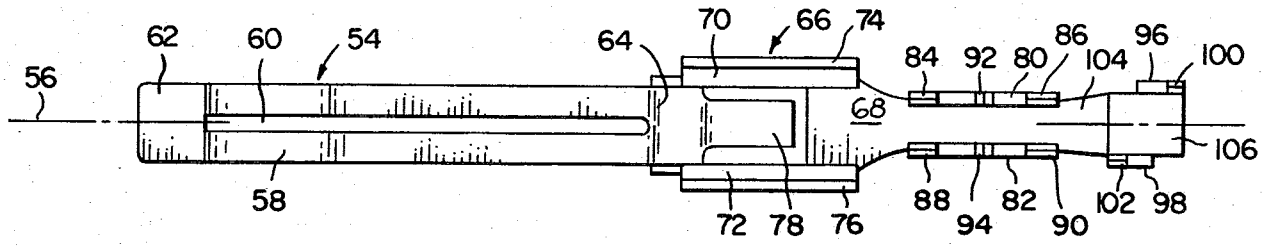
FIG. 5 is a plan elevation of a further embodiment of a connector in accordance with the invention.
Figure 6:
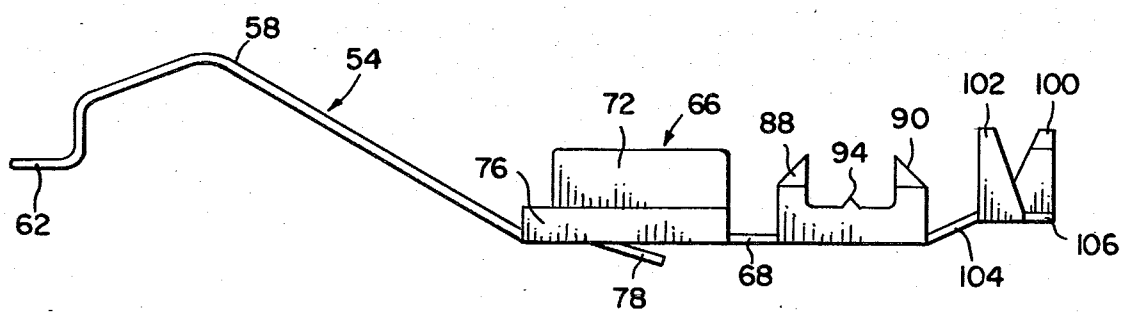
FIG. 6 is a front elevational view of the FIG. 5 connector.

Turning now to FIGS. 5 and 6, a further version of a connector in accordance with the invention is illustrated in plan and front elevation. Connector 54 is of type providing electrical continuity between the flat multiconductor cable of FIG. 1 and traces upon a printed circuit board, i.e., card edge contacts. Connector 54 is elongate along longitudinal axis 56 and includes a spring contact or terminal 58 having slit 60 and end tab 62. The terminal is hinged at location 64 to seating structure 66, in turn connected to web portion 68 of the connector. In use of connector 54, the seating structure 66 is disposed in a suitable housing which also supports tab 62 and defines an opening into which a printed circuit board may be inserted to engage terminal 58. Seating structure 66 may comprise sidewalls 70 and 72, base walls 74 and 76 and a detent lug 78, which typically bites into a plastic housing containing terminal 58, tab 62 and seating structure 66.

Rightwardly of seating structure 66, the connector of FIGS. 5 and 6 is of similar structure to the connector of FIGS. 1–4. Thus, side margins 80 and 82 are laterally spaced as in the case of side margins 26 and 28 above. Teeth 84–90 are accordingly placed in registry with a conductor of flat cable 10 in assembly. Notch teeth 92 and 94 may again be provided. Outer side margins 96 and 98 are spaced as in the case of side margins 42 and 44 above, such that teeth 100 and 102 may be arranged for insulation piercing and conductor avoidance in assembly. Web inclined section 104 provides for parallel spacing as between web portion 68 and web end section 106. As in the earlier embodiment, such parallel spacing between web end section and interior web portion provides for imposition of strain forces applied to the flat cable on teeth 100 and 102 in connector 54 or upon teeth 46 and 48 in connector 16.

As will be seen from the foregoing, in one preferred practice, the connectors of the invention provide for a strain relief capability which is independent of, although additional to, engagement of teeth with conductors of flat cable. For this purpose, pairs of teeth for the functions of electrical connection and strain relief absent electrical connection are arranged in different longitudinal disposition and in different lateral spacings about the longitudinal axis of the connector. While the teeth having electrical connection capability are shown in opposed pairs, one may evidently vary from this configuration per design choice to use a simple pair of opposed teeth in registry with a flat cable conductor, without notch teeth. Likewise, one may wish to include but a single strain relief tooth disposed laterally outwardly of one of the simple pair of electrical connection teeth employed.

In an alternate preferred practice, one may employ connectors of the invention with all connector teeth inboard of the side margins of the cable conductors, i.e., with $D_2$ still greater than $D_1$ (FIG. 1), but both $D_1$ and $D_2$ less than the conductor width. In this practice all teeth pierce both insulation and conductor. In such practice strain is relieved along separate longitudinal axes of each conductor, namely, the longitudinal axes of the transversely inner teeth 30–36 and the longitudinal axes of the transversely outer teeth 46 and 48.

The foregoing and other modifications will now be evident to those skilled in the art. The preferred embodiments and the foregoing discussion thereof are accordingly intended in an illustrative and not in a limiting sense.

What is claimed is:

1. An electrical connector for terminating flat cable having elongate conductors each of predetermined lateral expanse disposed within an insulative casing, said connector comprising an electrically conductive elongate member having a web portion and a terminal portion, said web portion defining first and second laterally opposed side margins spaced apart a distance not greater than said predetermined conductor expanse and a further side margin laterally outward of one of said first and second side margins, first and second insulation-piercing and conductor-penetrating teeth extending respectively from said web portion at said first and second side margins and an insulation-piercing tooth extending from said web portion at said further side margin.

2. The connector claimed in claim 1 wherein said terminal portion is located at an end of said conductive member and wherein said further tooth is located at an opposite end of said conductive member, said first and second teeth being located longitudinally between said terminal portion and said further tooth.

3. The connector claimed in claim 1 wherein said first and second teeth have chamfered surfaces at ends thereof distal from said web portion and tapering respectively laterally outwardly toward said first and second side margins.

4. The connector claimed in claim 3 wherein said further tooth has a chamfered surface at the end thereof distal from said web portion and tapering laterally inwardly of said further side margin.

5. The connector claimed in claim 4 wherein said end of said further tooth is more distal from said web portion than said ends of said first and second teeth.

6. The connector claimed in claim 1 wherein said web portion includes a first plane section within said first and second side margins, a second plane section juxtaposed with said further side margin and parallel with said first plane section, and a third inclined section joining said first and second plane sections.

7. An electrical connector for terminating flat cable having elongate flat conductors each of predetermined width disposed within an insulative casing, said connector comprising an electrically conductive elongate member having a web portion and a terminal portion, first and second insulation-piercing and conductor-penetrating teeth extending from said web portion at respective first and second opposed parallel longitudinal side margins thereof and third and fourth insulation-piercing teeth extending from said web portion at respective third and fourth opposed parallel longitudinal side margins thereof, the lateral spacing between said first and second teeth being less in measure than the measure of lateral spacing between said third and fourth teeth and not greater in measure than said predetermined conductor width.

8. The connector claimed in claim 7 wherein said terminal portion is located at an end of said conductive member and wherein said third and fourth teeth are located at an opposite end of said conductive member, said first and second teeth being located longitudinally between said terminal portion and said third and fourth teeth.

9. The connector claimed in claim 7 wherein said first and second teeth have chamfered surfaces at ends thereof distal from said web portion and tapering respectively laterally outwardly toward said first and second side margins.

10. The connector claimed in claim 9 wherein said third and fourth teeth have chamfered surfaces at ends thereof distal from said web portion and tapering respectively laterally inwardly of said third and fourth side margins.

11. The connector claimed in claim 10 wherein said ends of said third and fourth teeth are each more distal from said web portion than said ends of said first and second teeth.

12. The connector claimed in claim 7 wherein said web portion includes a first plane section within said first and second side margins, a second plane section within said third and fourth side margins and parallel with said first plane section, and a third inclined section joining said first and second plane sections.

* * * * *